US011674643B2

(12) United States Patent
Sassi et al.

(10) Patent No.: US 11,674,643 B2
(45) Date of Patent: Jun. 13, 2023

(54) CORNER STRUCTURE FOR A SEALED, THERMALLY INSULATED TANK

(71) Applicant: Gaztransport Et Technigaz, Saint Remy les Chevreuse (FR)

(72) Inventors: Mohamed Sassi, Saint Remy les Chevreuse (FR); Ronan Le Bihan, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 4 days.

(21) Appl. No.: 17/266,559

(22) PCT Filed: Aug. 2, 2019

(86) PCT No.: PCT/FR2019/051899
§ 371 (c)(1),
(2) Date: Feb. 5, 2021

(87) PCT Pub. No.: WO2020/030871
PCT Pub. Date: Feb. 13, 2020

(65) Prior Publication Data

US 2021/0317950 A1 Oct. 14, 2021

(30) Foreign Application Priority Data

Aug. 6, 2018 (FR) ..... 1857325

(51) Int. Cl.
*F17C 3/02* (2006.01)
*F17C 1/12* (2006.01)
*F17C 3/04* (2006.01)

(52) U.S. Cl.
CPC ..... *F17C 3/027* (2013.01); *F17C 1/12* (2013.01); *F17C 3/04* (2013.01);
(Continued)

(58) Field of Classification Search
CPC .. F17C 3/025; F17C 1/12; F17C 3/027; F17C 3/04; F17C 2201/0157; F17C 2201/052;
(Continued)

(56) References Cited

U.S. PATENT DOCUMENTS

2017/0227164 A1 8/2017 Han et al.

FOREIGN PATENT DOCUMENTS

EP 1898143 A2 3/2008
JP 2008261130 A * 10/2008
(Continued)

*Primary Examiner* — Atif H Chaudry
(74) *Attorney, Agent, or Firm* — Blank Rome LLP

(57) ABSTRACT

The invention relates to a corner structure (16) for a leaktight and thermally insulating tank for storing a fluid, comprising a plurality of walls (1, 101, 201); the said corner structure (16) being intended to be arranged in a corner between a first wall (101) and a second wall (201) and comprising:

a first angle bracket (32) anchored to an anchoring device (16) intended to be fastened to the supporting structure (3) of the first and second walls (101, 201);

the anchoring device (16) comprising a first tab (18) and a second tab (19) intersecting one another, each of the first and second tabs (18, 19) comprising an external portion (24, 25) and an internal portion (22, 23) which are arranged on either side of an intersection between the first tab (18) and the second tab (19);

the corner structure (16) furthermore comprising a first insulating panel (42) which is arranged in a first space delimited by the internal portion (22) of the first tab (18) and the external portion (25) of the second tab (19), and a first lateral insulating packing element (48) which is compressed between the first insulating panel (42) and the external portion (25) of the second tab (19).

20 Claims, 5 Drawing Sheets

(52) U.S. Cl.
CPC .... *F17C 2201/052* (2013.01); *F17C 2203/03* (2013.01); *F17C 2203/0333* (2013.01); *F17C 2203/0345* (2013.01); *F17C 2203/0358* (2013.01); *F17C 2203/0617* (2013.01); *F17C 2203/0639* (2013.01); *F17C 2221/033* (2013.01); *F17C 2223/0161* (2013.01); *F17C 2223/033* (2013.01); *F17C 2270/0107* (2013.01)

(58) Field of Classification Search
CPC ..... F17C 2203/03; F17C 2203/0358; F17C 2203/0617; F17C 2203/0639; F17C 2221/033; F17C 2223/0161; F17C 2223/03; F17C 2260/013; F17C 2270/0105; F17C 2270/01; B63B 25/16
See application file for complete search history.

(56) References Cited

FOREIGN PATENT DOCUMENTS

| | | | |
|---|---|---|---|
| KR | 20130092238 | A | 8/2013 |
| KR | 20160091649 | A | 8/2016 |
| KR | 101884895 | B1 | 8/2018 |

* cited by examiner

CORNER STRUCTURE FOR A SEALED, THERMALLY INSULATED TANK

This application is a national phase application of PCT/FR2019/051899, filed Aug. 2, 2019 which claims priority to French Application No. 1857325 filed Aug. 6, 2018. The entire contents of those applications are incorporated herein by reference.

TECHNICAL FIELD

The invention relates to the field of leaktight and thermally insulating tanks for storing and/or transporting a fluid, such as liquefied gas, and more particularly concerns a corner structure for such a tank.

Leaktight and thermally insulating tanks are used in particular for the storage of liquefied natural gas (LNG), which is stored at atmospheric pressure at about −163° C., or for the storage of liquefied petroleum gas (LPG). These tanks may be installed on land or on a floating structure. In the case of a floating structure, the tank may be intended for transporting liquefied gas or for receiving liquefied gas which is used as fuel for propulsion of the floating structure.

TECHNOLOGICAL BACKGROUND

Document US20170227164 discloses a corner structure for a leaktight and thermally insulating tank. The corner structure comprises a mobile corner piece, which consists of a primary angle bracket and a secondary angle bracket that are separated from one another and are respectively welded to the primary sealing membranes of the two adjacent walls and to the secondary sealing membranes of the two adjacent walls. The mobile corner piece is mounted so that it can slide on an anchoring device, which comprises two tabs arranged perpendicularly to one another and fastened to a base, which is anchored to the supporting structure of each of the two adjacent walls. The two tabs each comprise openings and connecting tongues formed between the openings, the connecting tongues of each of the two tabs passing through the openings of the other tab. This is intended to limit the stress concentrations in the corner structure.

In order to thermally insulate the corner structure, it comprises a first insulating panel which is arranged against the supporting structure of the first wall and fills a space delimited by the internal portion of the first tab and the external portion of the second tab. Likewise, the corner structure comprises a second insulating panel which is arranged against the supporting structure of the second wall and fills a space delimited by the internal portion of the second tab and the external portion of the first tab. Insulating elements are also positioned in the space formed between the external portions of the first and second tabs. A triangular space is left unoccupied between the mobile corner piece and the internal portions of the two tabs. Another triangular space is also unoccupied, on the other side of the intersection between the two tabs, in the region delimited by the external portions of the two tabs. The aforementioned empty triangular spaces make it possible to increase the freedom of movement of the two tabs so as to limit the stress concentrations in the corner structure even more.

It has, however, been observed that the thermal insulation performance of such a corner structure is not satisfactory.

SUMMARY

One underlying concept of the invention is to provide a corner structure of the aforementioned type, in which the thermal insulation performance is enhanced.

According to one embodiment, the invention provides a corner structure for a leaktight and thermally insulating tank for storing a fluid, comprising a first wall and a second wall, each of which has successively, in a thickness direction of the said wall, from the outside to the inside of the tank, a supporting structure, a thermally insulating barrier held to the supporting structure, and a sealing membrane supported by the said thermally insulating barrier; the said corner structure being intended to be arranged in a corner between the first wall and the second wall, the corner structure comprising:

a first angle bracket having a first wing and a second wing, which respectively extend in a first plane intended to be positioned parallel to the first wall, and in a second plane intended to be positioned parallel to the second wall, the first wing and the second wing being respectively intended to be welded in a leaktight manner to the sealing membrane of the first wall and the sealing membrane of the second wall; the said first angle bracket being anchored to an anchoring device intended to be fastened to the supporting structure of the first and second walls; the anchoring device comprising a first tab and a second tab intersecting one another, the first tab and the second tab extending respectively parallel to the first and second planes, each of the first and second tabs comprising an external portion and an internal portion which are arranged on either side of an intersection between the first tab and the second tab, the first wing of the first angle bracket being secured to the internal portion of the first tab, and the second wing of the first angle bracket being secured to the internal portion of the second tab, the external portion of the first tab and the external portion of the second tab being intended to extend from the intersection respectively towards the supporting structure of the second wall and towards the supporting structure of the first wall;

the corner structure furthermore comprising a first insulating panel which is arranged in a first space delimited by the internal portion of the first tab and the external portion of the second tab, and a first lateral insulating packing element which is compressed between the first insulating panel and the external portion of the second tab.

Thus, the first lateral insulating packing element being compressed, it is capable of expanding in order to compensate for the thermal contraction of the first insulating panel. The first lateral insulating packing element therefore makes it possible to ensure continuity of the thermal insulation and to limit the phenomena of conviction inside the corner structure.

According to embodiments, such a corner structure may have one or more of the following characteristics.

According to one embodiment, the first plane and the second plane are perpendicular to one another.

According to another embodiment, the first plane and the second plane form an angle of 135°.

According to one embodiment, the corner structure furthermore comprises a second insulating panel which is arranged in a second space delimited by the internal portion of the second tab and the external portion of the first tab, and a second lateral insulating packing element which is compressed between the second insulating panel and the external portion of the first tab.

According to one embodiment, the first and/or second insulating panel comprises a polymer foam layer selected from polyurethane foam, polyethylene foam and polyvinyl chloride foam.

According to one embodiment, the polymer foam layer of the first and/or second insulating panel is reinforced with fibres. This makes it possible, in particular, to limit the thermal contraction of the said insulating panel. According to one embodiment, the fibres are glass fibres.

According to another embodiment, the polymer foam layer of the first and/or second insulating panel is free of fibres. The insulating panel(s) is/are thus less expensive. Furthermore, the thermal contraction of the said insulating panel may at least partly be compensated for by the first or the second lateral insulating packing element.

According to one embodiment, the insulating polymer foam layer of the first and/or second insulating panel has a density of between 90 and 240 kg/m$^3$.

According to one embodiment, the first and/or second lateral insulating packing elements have a density of less than 90 kg/m$^3$, and preferably between 20 and 50 kg/m$^3$. Such a material is particularly easy to compress.

According to one embodiment, the first and/or second lateral insulating packing element comprises a layer made of a material selected from glass wool, mineral wool, polyester wadding, polyurethane foam, melamine foam, polyethylene foam, polypropylene foam or silicone foam.

According to one embodiment, the first lateral insulating packing element comprises a plurality of layers which are made of glass wool and are separated from one another by spacers extending parallel to the first plane. This makes it possible to limit the convection inside the glass wool.

According to one embodiment, the second lateral insulating packing element comprises a plurality of layers which are made of glass wool and are separated from one another by spacers extending parallel to the second plane. This makes it possible to limit the convection inside the glass wool.

According to one embodiment, the spacers are made of kraft paper.

According to one embodiment, the first angle bracket comprises a central portion which connects the first wing and the second wing of the said first angle bracket and is inclined with respect to the first plane and the second plane, the central portion of the first angle bracket defining, with the internal portion of the first tab and the internal portion of the second tab, an internal space with a triangular cross section, the said internal space with a triangular cross section being stuffed with an internal insulating packing element which is compressed between the central portion of the first angle bracket, the internal portion of the first tab and the internal portion of the second tab.

According to one embodiment, the central portion is perpendicular to the bisector of the angle formed at the intersection between the first and second planes.

According to one embodiment, the internal insulating packing element has a density of less than 90 kg/m$^3$, and preferably between 20 and 50 kg/m$^3$.

According to one embodiment, the internal insulating packing element comprises a layer made of a material selected from glass wool, mineral wool, polyester wadding, polyurethane foam, melamine foam, polyethylene foam, polypropylene foam or silicone foam.

According to one embodiment, the second lateral insulating packing element comprises a plurality of layers which are made of glass wool and are separated from one another by spacers, for example made of kraft paper, extending parallel to the central portion of the angle bracket.

According to one embodiment, the anchoring device furthermore comprises a base on which the external portions of the first and second tabs are fastened, the base comprising a first fastening portion intended to be fastened to the supporting structure of the first wall, and a second fastening portion intended to be fastened to the supporting structure of the second wall, the base furthermore comprising a connecting portion which connects the first fastening portion and the second fastening portion and is inclined with respect to the first plane and the second plane, the connecting portion of the base defining, on the one hand, a first external space with a triangular cross section delimited by the connecting portion of the base, the external portion of the first tab and the external portion of the second tab, and on the other hand a second external space with a triangular cross section intended to be delimited by the connecting portion of the base, the supporting structure of the first wall and the supporting structure of the second wall.

According to one embodiment, the first fastening portion is parallel to the first plane and fastened to the external portion of the second tab.

According to one embodiment, the second fastening portion is parallel to the second plane and fastened to the external portion of the first tab.

According to one embodiment, the connecting portion of the base is perpendicular to the bisector of the angle formed at the intersection between the first and second planes.

According to one embodiment, the first external space with a triangular cross section is stuffed with a first external insulating packing element which is compressed between the external portion of the first tab, the external portion of the second tab and the connecting portion of the base.

According to one embodiment, the corner structure comprises an insulating panel with a trapezoidal cross section, which is accommodated in the first external space with a triangular cross section, while bearing against the connecting portion of the base, and the rest of the first external space with a triangular cross section is stuffed with a first external insulating packing element which is compressed between the insulating panel with a trapezoidal cross section, the external portion of the first tab and the external portion of the second tab.

According to one embodiment, the first external insulating packing element has a density of less than 90 kg/m$^3$, and preferably between 20 and 50 kg/m$^3$.

According to one embodiment, the first external insulating packing element comprises a layer made of a material selected from glass wool, mineral wool, polyester wadding, polyurethane foam, melamine foam, polyethylene foam, polypropylene foam or silicone foam.

According to one embodiment, the first external insulating packing element comprises a plurality of layers which are made of glass wool and are separated from one another by spacers, for example made of kraft paper, extending parallel to the connecting portion of the base.

According to one embodiment, the second external space with a triangular cross section is stuffed with a second external insulating packing element.

According to one embodiment, the second external insulating packing element is arranged in order to be compressed between the connecting portion of the base, the supporting structure of the first wall and the supporting structure of the second wall.

According to one embodiment, the second external insulating packing element is compressed between the connecting portion of the base, a rigid external plate applied against the supporting structure of the first wall and a rigid external plate applied against the supporting structure of the second wall.

According to one embodiment, the second external insulating packing element has a density of less than 90 kg/m$^3$, and preferably between 20 and 50 kg/m$^3$.

According to one embodiment, the second external insulating packing element comprises a layer made of a material selected from glass wool, mineral wool, polyester wadding, polyurethane foam, melamine foam, polyethylene foam, polypropylene foam or silicone foam.

According to one embodiment, the second external insulating packing element comprises a plurality of layers which are made of glass wool and are separated from one another by spacers, for example made of kraft paper, extending parallel to the connecting portion of the base.

According to one embodiment, the first external space with a triangular cross section and the second external space with a triangular cross section are respectively filled with at least one first external insulating packing element and one second external insulating packing element, the corner structure furthermore comprising a third insulating panel and a fourth insulating panel on either side of the anchoring device in a direction parallel to the corner between the first wall and the second wall, the corner structure furthermore comprising a third insulating packing element which is compressed between, on the one hand, the third insulating panel and, on the other hand, the first external insulating packing element and the second external insulating packing element, and a fourth insulating packing element which is compressed between, on the one hand, the fourth insulating panel and, on the other hand, the first external insulating packing element and the second external insulating packing element.

According to one embodiment, each of the first and second tabs comprises openings and connecting tongues formed between the openings, the connecting tongues of each of the first and second tabs passing through the openings of the other of the first and second tabs.

According to one embodiment, the first wing and the second wing of the first angle bracket are mounted so that they can slide in a direction parallel to the intersection between the first tab and the second tab, respectively over the internal portion of the first tab and the internal portion of the second tab.

According to one embodiment, the sealing membrane of the first wall and of the second wall, to which the first wing and the second wing of the first angle bracket are welded, is a secondary sealing membrane; the corner structure furthermore comprising a second angle bracket which is separated from the first angle bracket by one or more struts, the second angle bracket comprising a first wing which is parallel to the first plane and is intended to be welded to a primary sealing membrane of the first wall, and a second wing which is parallel to the second plane and is intended to be welded to a primary sealing membrane of the second wall.

It should be noted that, although in a preferred embodiment the first lateral insulating packing element, the second lateral insulating packing element, the internal insulating packing element, the first external insulating packing element and the second external insulating packing element are used in combination, they may also be used independently of one another, and in particular without the corner structure comprising a first lateral insulating packing element.

According to one embodiment, the invention also provides a leaktight and thermally insulating tank, comprising a first wall and a second wall, having successively, in a thickness direction of the said wall, from the outside to the inside of the tank, a supporting structure, a thermally insulating barrier held to the supporting structure, and a sealing membrane supported by the said thermally insulating barrier; the said leaktight and thermally insulating tank comprising an aforementioned corner structure arranged in a corner between the first wall and the second wall; the first wing and the second wing of the first angle bracket being respectively welded in a leaktight manner to the sealing membrane of the first wall and the sealing membrane of the second wall, and the anchoring device being fastened to the supporting structure of the first and second walls.

According to one embodiment, the invention also provides a ship comprising an aforementioned tank.

According to one embodiment, the invention also provides a method for loading or unloading such a ship, in which a fluid is conveyed through insulated pipelines from or to a floating or onshore storage facility to or from the tank of the ship.

According to one embodiment, the invention also provides a transfer system for a fluid, the system comprising the aforementioned ship, insulated pipelines arranged so as to connect the tank installed in the hull of the ship to a floating or onshore storage facility, and a pump for delivering a fluid through the insulated pipelines from or to the floating or onshore storage facility to or from the tank of the ship.

BRIEF DESCRIPTION OF THE FIGURES

The invention will be understood better, and further objects, details, characteristics and advantages thereof will become clearer during the following description of several particular embodiments of the invention, which are given solely by way of illustration and without limitation, with reference to the appended drawings.

DETAILED DESCRIPTION OF EMBODIMENTS

By convention, the terms "external" and "internal" are used to define the relative position of one element with respect to another, with reference to the inside and outside of the tank.

Figure 1:
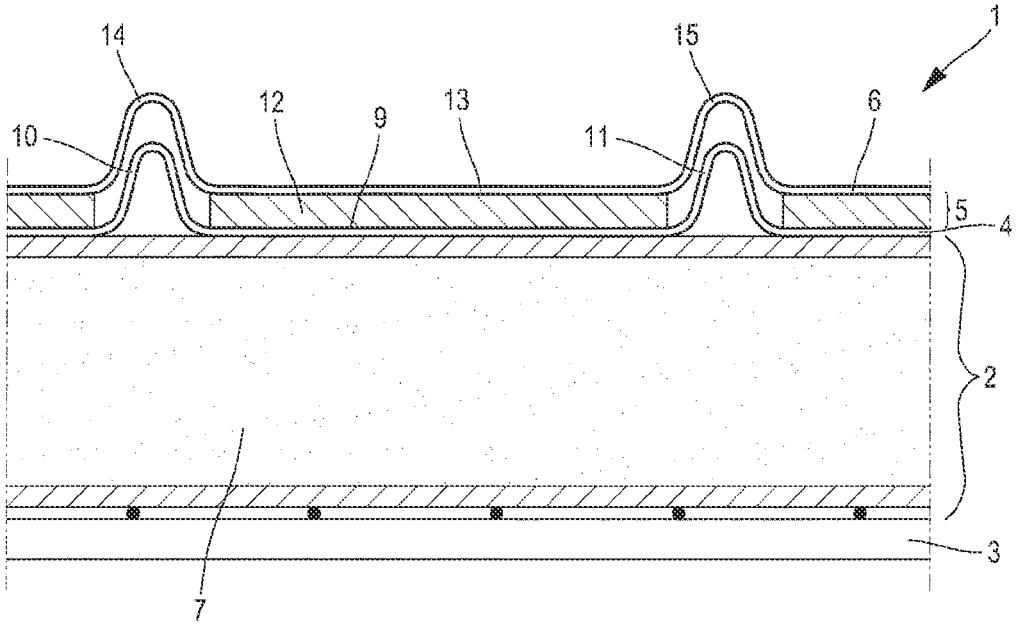
FIG. 1 is a view in section of a wall of a leaktight and thermally insulating tank.

In relation to FIG. 1, a wall 1 for a leaktight and thermally insulating tank intended for storing a liquefied gas is described. The liquefied gas may, in particular, be a liquefied natural gas (LNG) or liquefied petroleum gas (LPG).

Each wall 1 comprises a multilayer structure which has successively, from the outside to the inside of the tank, in the thickness direction of the wall, a secondary thermally insulating barrier 2 resting against a supporting structure 3, a secondary sealing membrane 4 anchored on the secondary thermally insulating barrier 2, a primary thermally insulating barrier 5 resting against the secondary sealing membrane 4, and a primary sealing membrane 6 intended to be in contact with the liquefied gas contained in the internal space of the tank.

The supporting structure 3 is, for example, formed by the double hull of a ship, but may more generally also be formed from any type of rigid partition which has suitable mechanical properties.

The secondary thermally insulating barrier 2 comprises insulation blocks 7 which are juxtaposed and anchored on the supporting structure 3. According to one embodiment, each insulation block 7 comprises an insulating polymer foam layer sandwiched between an internal rigid plate and an external rigid plate. The internal and external rigid plates are, for example, plates of plywood adhesively bonded onto the said insulating polymer foam layer. The insulating polymer foam may in particular be a polyurethane foam, optionally high-density and optionally reinforced with glass fibres. The insulation blocks 7 are anchored to the supporting structure 3 by means of fastening devices (not represented).

The secondary sealing membrane 4 comprises a plurality of metal sheets 9 which are lap-welded to one another in a leaktight fashion. The metal sheets 9 have corrugations 10, 11 which allow the secondary sealing membrane 4 to be flexible, so that it can deform under the effect of the thermal and mechanical stresses generated by the liquefied gas stored in the tank. The metal sheets 9 are anchored to the supporting structure 3, either by welding onto the fastening devices which fasten the insulation blocks 7 on the supporting structure 3, or by welding onto metal plates fastened to the insulation blocks 7.

The primary thermally insulating barrier 5 comprises a plurality of rigid plates 12, for example made of plywood, resting against the secondary sealing membrane 4. The rigid plates 12 are intended to maintain a spacing in the thickness direction of the tank wall between the primary sealing membrane 6 and the secondary sealing membrane 4. The rigid plates 12 are, for example, anchored on the secondary sealing membrane 4.

The primary thermally insulating barrier 5 comprises a plurality of openings through which the corrugations 10, 11 of the secondary sealing membrane 4 project into the tank.

The primary sealing membrane 6 comprises a plurality of metal sheets 13 which are lap-welded to one another in a leaktight fashion. The metal sheets 13 also have corrugations 14, 15 which allow the primary sealing membrane 6 to be flexible. The corrugations 14, 15 of the primary sealing membrane 6 are positioned in line with the corrugations 10, 11 of the secondary sealing membrane 4, so that the corrugations 10, 11 of the secondary sealing membrane 4 project inside the corrugations 14, 15 of the primary sealing membrane 6. The metal sheets 13 are anchored to the supporting structure 3, either by welding onto the fastening devices which anchor the rigid plates 12 onto the supporting structure 3, or by welding onto metal plates fastened on the rigid plates 12.

Figure 3:
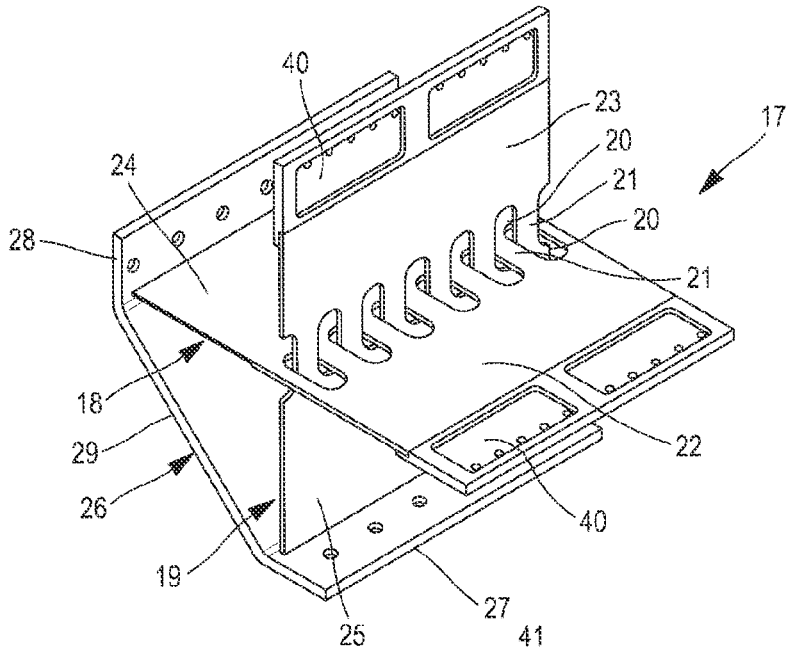
FIG. 3 is a perspective view of an anchoring device intended to anchor a corner piece to the supporting structures.
Figure 4:
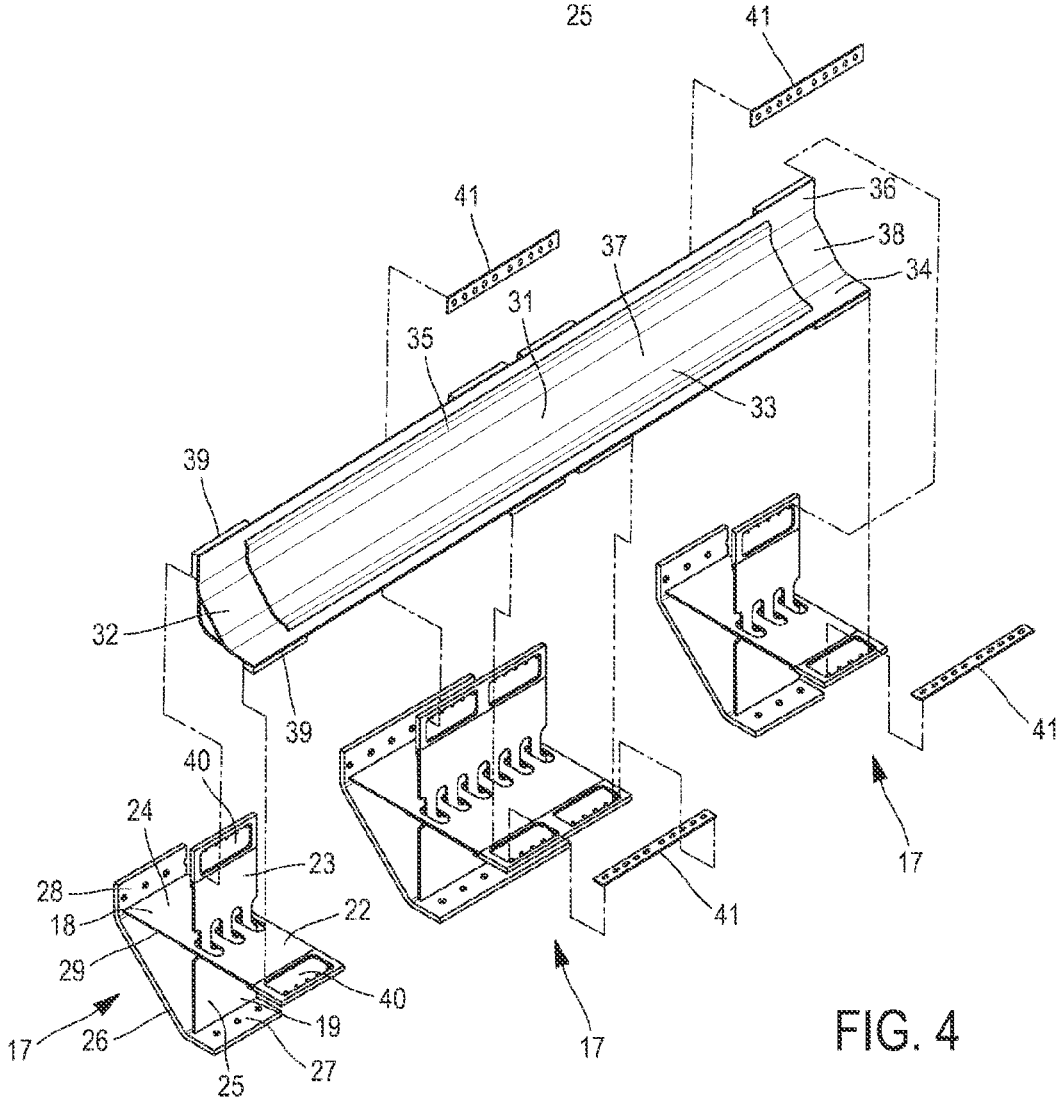
FIG. 4 is an exploded perspective view of the anchoring device and the corner piece.
Figure 5:
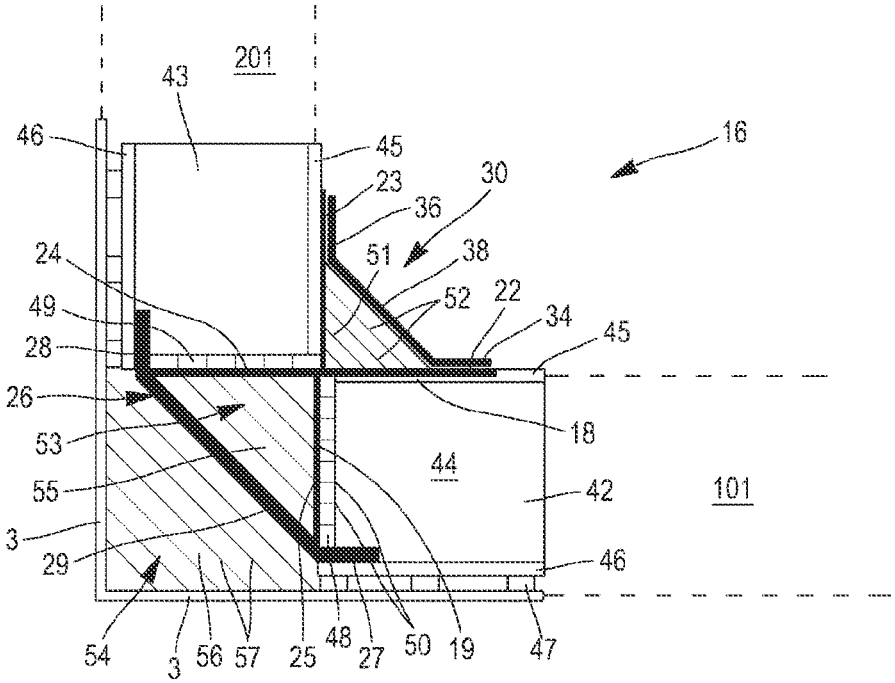
FIG. 5 is a view in section of a corner structure according to a first embodiment.

In relation to FIGS. 2 to 5, a corner structure 16 arranged at the intersection between a first and a second wall, which are referenced 101, 102 in FIG. 5, can be seen. In the embodiment represented, the corner structure 16 is intended for a corner of the tank in which the first wall 101 and the second wall 201 are perpendicular to one another. According to other embodiments (not represented), however, the angle formed at the intersection between the first wall 101 and the second wall 201 is different to 90°, and is for example 135°.

The corner structure 16 comprises anchoring devices 17, which are intended to be regularly distributed along the corner formed at the intersection between the first wall 101 and the second wall 201. The anchoring devices 17 are intended to anchor the secondary and primary sealing membranes 4, 6 to the supporting structure 3 at the corner structure 16.

Figure 2:
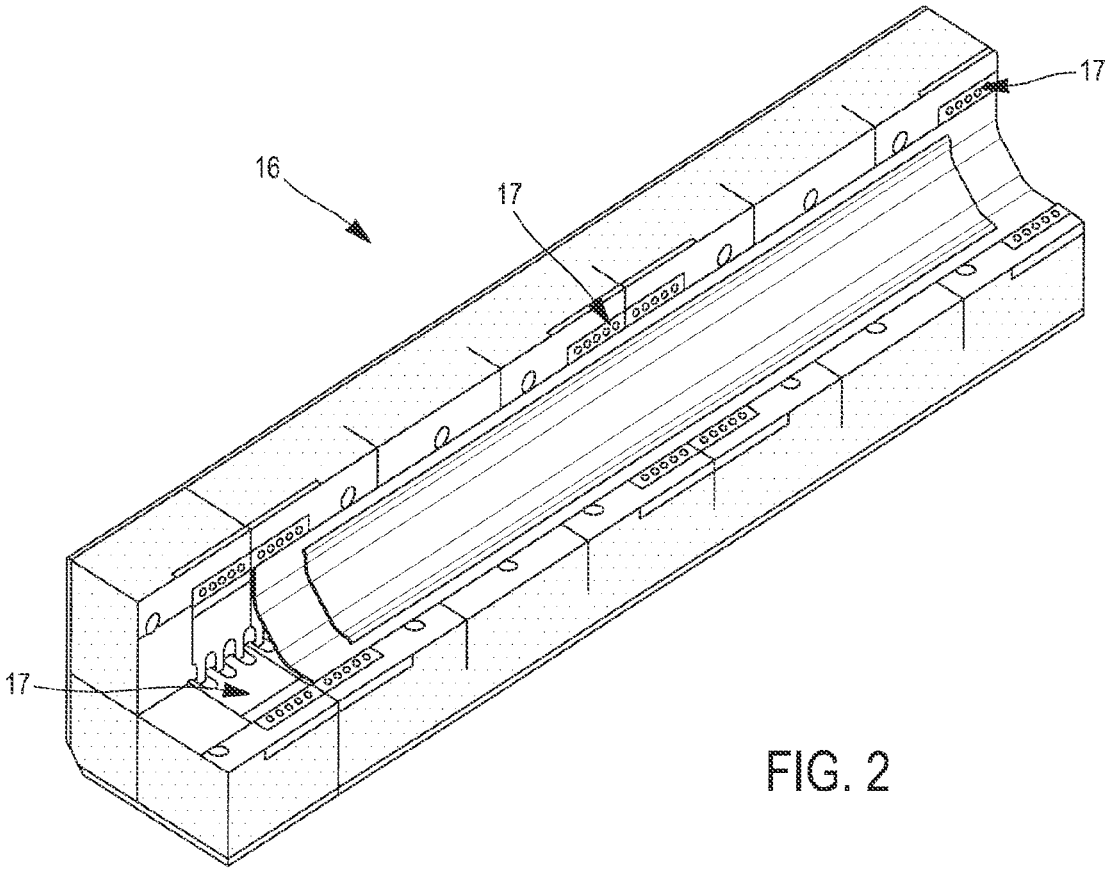
FIG. 2 is a perspective view of a corner structure.

In relation to FIGS. 3 and 4, an anchoring device 16 is described. Each anchoring device 16 comprises a first tab 18 and a second tab 19, which intersect one another. The first tab 18 is intended to be positioned parallel to the first wall 101, whereas the second tab 19 is intended to be positioned parallel to the second wall 201. The first and second tabs 18, 19 thus form a cross. When the angle formed at the intersection of the first wall 101 and the second wall 201 is 90°, as in FIGS. 2 to 5, the first and second tabs 18, 19 are perpendicular to one another.

Each of the first and second tabs 18, 19 comprises an internal portion 22, 23 and an external portion 24, 25, arranged respectively on either side of the intersection between the first and second tabs 18, 19. Furthermore, in the intersection region of the first and second tabs 18, 19, each of the first and second tabs 18, 19 comprises openings 20 and connecting tongues 21 formed between the openings 20. The connecting tongues 21 thus connect the internal portion 22, 23 to the external portion 24, 25 of the said first or second tab 18, 19.

The connecting tongues 21 of the first tab 18 pass through the openings 20 of the second tab 19, whereas the connecting tongues 21 of the second tab 19 pass through the openings 20 of the second tab 19. In order to allow such assembly of the first and second tabs 18, 19, at least one of the first and second tabs 18, 19 is produced in two parts, which are welded to one another at the connecting tongues 21 after the said connecting tongues 21 have been inserted through openings 20 of the other tab 18, 19. Such assembly is advantageous insofar as it makes it possible to avoid stress concentrations at the intersection between the first and second tabs 18, 19.

Each anchoring device 16 furthermore comprises a base 26, by means of which the first and second tabs 18, 19 are secured to the supporting structure 3 of the first wall 101 and of the second wall 201. The base 26 comprises a first and a second fastening portion 27, 28, which are respectively parallel to the first wall 101 and the second wall 201. The first fastening portion 27 is intended to be fastened against the supporting structure 3 of the first wall 101, whereas the second fastening portion 28 is fastened against the second wall 201. In one embodiment, each of the first and second fastening portions 27, 28 comprises holes through which threaded bolts (not represented) pass, these bolts cooperating with nuts so as to fasten the said fastening portions 27, 28 to the supporting structure 3 of the respective wall 101, 201.

Furthermore, the base 26 comprises a connecting portion 29 which connects the first and second fastening portions 27, 28. The connecting portion 29 extends perpendicularly to the bisector of the angle formed at the intersection between the first and second walls 101, 201. Thus, when the angle formed at the intersection between the first and second walls 101, 201 is 90°, as in the embodiment represented, the connecting portion 29 is inclined by an angle of 45° with respect to the first and second walls 101, 201.

The first tab 18 and the second tab 19 are welded onto the base 26. More particularly, the end of the external portion 24 of the first tab 18 is fastened onto the second fastening portion 28 of the base 26, and the end of the external portion 25 of the second tab 19 is welded onto the first fastening portion 27.

Furthermore, the corner structure 16 comprises a corner piece 30, represented particularly in FIGS. 2, 4 and 5, which is mounted so that it can move in translation on the internal portions 22, 23 of the first and second tabs 18, 19 of the anchoring devices 17. The corner piece 30 comprises two angle brackets, namely a primary angle bracket 31 and a secondary angle bracket 32. Each of the primary 31 and secondary 32 angle brackets comprises a first wing 33, 34 parallel to the first wall 101, a second wing 35, 36 parallel to the second wall 201, and a central portion 37, 38 which connects the first and second wings 33, 34, 35, 36 of the said primary 31 or secondary 32 angle bracket. The central portion 37, 38 of each of the primary 31 and secondary 32 angle brackets extends perpendicularly to the bisector of the angle formed at the intersection between the first and second walls 101, 201. Thus, in the embodiment represented, the central portion 37, 38 is inclined by an angle of 45° with respect to the first and second walls 101, 201.

The primary angle bracket 31 and the secondary angle bracket 32 are separated from one another by means of one or more struts (not represented). The struts are, for example, made of plywood and comprise metal plates onto which the primary angle bracket 31 and the secondary angle bracket 32 are welded. The first wing 34 and the second wing 36 of the secondary angle bracket 32 respectively project beyond the first wing 33 and the second wing 35 of the primary angle bracket 31.

The first wing 34 and the second wing 36 of the secondary angle bracket 32 are respectively intended to be welded in a leaktight fashion to the secondary sealing membrane 4 of the first wall 101 and of the second wall 201, whereas the first wing 33 and the second wing 35 of the primary angle bracket 31 are respectively intended to be welded in a leaktight fashion to the primary sealing membrane 6 of the first wall 101 and of the second wall 201. The primary angle bracket 31 and the secondary angle bracket 32 thus ensure continuity of the sealing of the primary 6 and secondary 4 sealing membranes at the corner structure 16.

As represented in FIG. 4, in order to ensure mobility of the corner piece 30 in translation with respect to the anchoring device 16, the corner piece 30 comprises guide projections 39 which are received in guide grooves 40. The guide projections 39 project from the outer face of the first and second wings 34, 36 of the secondary angle bracket 32. The guide grooves 40 are formed in proximity to the internal end of the internal portions 22, 23 of the first and second tabs 18, 19. Furthermore, the corner structure 16 comprises stop elements 41 which make it possible to prevent the guide projections 39 escaping from the guide grooves 40. In order to do this, the guide projections 39 project beyond one of the wings 34, 36 of the secondary corner structure 32, and the stop elements 40 are fastened to the internal portion 22, 23, while covering a part of one of the guide projections 39 so as to prevent it escaping from the guide groove 40.

Furthermore, the corner structure 16 comprises insulating elements making it possible to thermally insulate said corner structure 16.

As represented in FIG. 5, the corner structure 16 comprises a first and a second insulating panel 42, 43, which are respectively arranged in a first space which is delimited by the supporting structure 3 of the first wall 101, the internal portion 22 of the first tab 18 and the external portion 25 of the second tab 19, and in a second space which is delimited by the supporting structure 3 of the first wall 201, the internal portion 23 of the second tab 19 and the external portion 24 of the first tab 18. The first and second insulating panels 42, 43 are capable of extending along a plurality of anchoring devices 17 distributed along the intersection between the first wall 101 and the second wall 201.

Each of the first and second insulating panels 42, 43 comprises an insulating polymer foam layer 44, which advantageously has a density of between 90 and 240 kg/m$^3$. The insulating polymer foam layer 44 is advantageously a polyurethane foam, although it may also be a polyethylene foam or a polyvinyl chloride foam. According to one embodiment, the insulating polymer foam layer 44 is reinforced with fibres, such as glass fibres. This makes it possible, in particular, to limit the thermal contraction of the foam. According to another embodiment, the polymer foam is free of fibres, and is consequently less expensive.

The insulating polymer foam layer 44 is sandwiched between two rigid plates, internal 45 and external 46, which are adhesively bonded onto the said insulating polymer foam layer 44. The rigid plates, internal 45 and external 46, are for example made of plywood.

The first panel 42 is intended to be fastened against the supporting structure 3 of the first wall 101, and the second panel 43 is intended to be fastened against the supporting structure 3 of the second wall 201. The first and second panels 42, 43 are, for example, fixed to the respective supporting structure 3 by means of threaded bolts (not represented), which are welded to the said supporting structure 3 and which pass through recesses (not represented) formed in the said first and second panels 42, 43. Nuts are screwed onto the bolts and bear against the bottom of the recesses so as to hold the said first and second panel 42, 43 to the supporting structure 3. According to one embodiment, beads 47 of polymerizable resin are arranged between the supporting structure 3 and the external plate 46 of the first and second panels 42, 43 in order to compensate for planarity defects.

Furthermore, the corner structure 16 comprises a first lateral insulating packing element 48, which is compressed between the first panel 42 and the external portion 25 of the second tab 19. Likewise, the corner structure 16 comprises a second lateral insulating packing element 49, which is compressed between the second panel 43 and the external portion 24 of the first tab 18. The lateral insulating packing elements 48, 49 are thus capable of relaxing and filling the plays when, when the tank is being cooled, the first insulating panel 42 and the second insulating panel 43 contract. The lateral insulating packing elements 48, 49 thus make it possible to eliminate or reduce as far as possible the convection movements inside the corner structure 16. The lateral insulating packing elements 48, 49 have a density of less than 90 kg/m$^3$, and for example between 20 and 50 kg/m$^3$. They are for example made of glass wool, but may also be made of mineral wool, polyester wadding, polyurethane foam, melamine foam, polyethylene foam, polypropylene foam or silicone foam. The lateral insulating packing elements 48, 49 have, for example, a width of between 20 mm and 60 mm. Such lateral insulating packing elements are advantageously arranged over the entire length of the corner structure 16.

Figure 6:
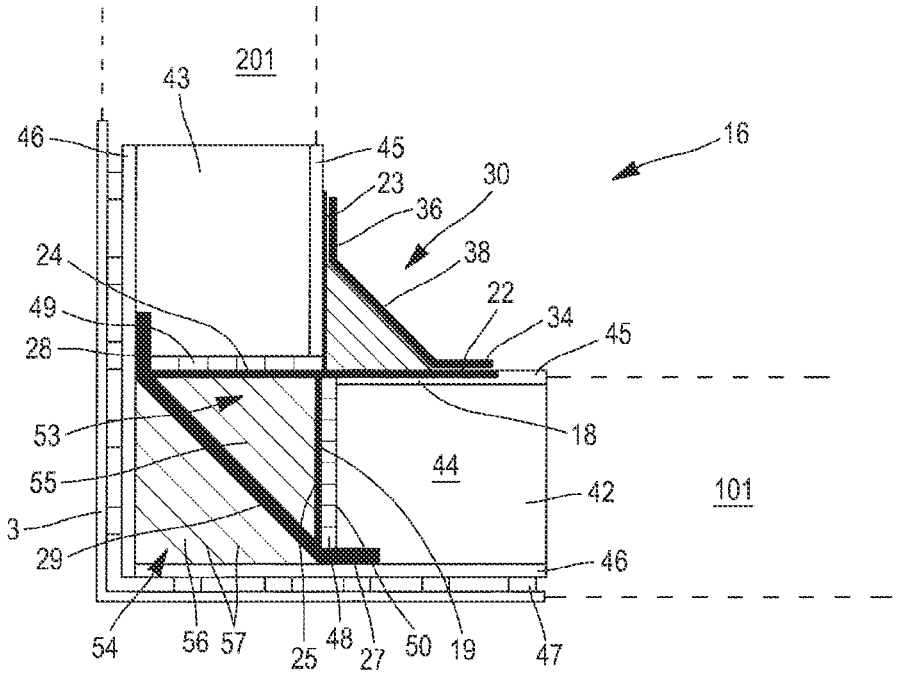
FIG. 6 is a view in section of a corner structure according to a second embodiment.

In the embodiment represented in FIG. 6, the lateral insulating packing elements 48, 49 have a stack of glass wool layers which are separated from one another by spacers 50, for example made of kraft paper. Advantageously, the spacers 50 are parallel to the first wall 101 in the case of the first lateral insulating packing element 48, and parallel to the second wall 201 in the case of the second lateral insulating packing element 49. Thus, such spacers 50 make it possible to limit the convection movements inside the glass wool.

Furthermore, the corner structure 16 also comprises an internal insulating packing element 51, which has a triangular cross section. The internal insulating packing element 51 is stuffed into the internal space with a triangular cross section which is defined by the internal portion 22 of the first tab 18, the internal portion 23 of the second tab 19 and the central portion 38 of the secondary angle bracket 32. Thus, the internal insulating packing element 51 is compressed between the internal portion 22 of the first tab 18, the internal portion 23 of the second tab 29 and the central portion 38 of the secondary angle bracket 32. Such an internal insulating packing element 51 makes it possible to ensure continuity of the thermal insulation and to limit the convection movements in the corner structure 16. Advantageously, one or more internal insulating packing elements 51 extend over the entire length of the corner structure 16.

The internal insulating packing element 51 is made of one of the materials mentioned above in connection with the lateral insulating packing elements 48, 49.

In the embodiment represented in FIG. 5, the internal insulating packing element 51 has a stack of glass wool layers which are separated from one another by spacers 52, for example made of kraft paper. In order to limit the convection movements inside the glass wool, the spacers 52 are advantageously oriented orthogonally to the bisector of the angle formed at the intersection between the first wall 101 and the second wall 201.

Furthermore, the connecting portion 29 of the base 26 separates the space delimited by the external portions 24, 25 of the first and second tabs 18, 19, and by the supporting structure 3 of the first and second walls 101, 201, into a first external space with a triangular cross section 53 and a second external space with a triangular cross section 54. The first external space with a triangular cross section 53 is delimited by the external portions 24, 25 of the first and second tabs 18, 19 and the connecting portion of the base 26, whereas the second external space with a triangular cross section 54 is delimited by the connecting portion 29 of the base 26, the supporting structure 3 of the first wall 101 and the supporting structure 3 of the second wall 201.

The corner structure 16 comprises a first external insulating packing element 55, which is stuffed into the first external space with a triangular cross section 53. The first external insulating packing element 55 advantageously has a triangular cross section and is compressed between the external portions 24, 25 of the first and second tabs 18, 19 and the connecting portion 29 of the base 26.

The corner structure 16 furthermore comprises a second external insulating packing element 56 which is stuffed into the second external space with a triangular cross section 54 and is thus compressed between the connecting portion 29 of the base 26, the supporting structure 3 of the first wall 101 and the supporting structure 3 of the second wall 201.

The first and second external insulating packing elements 55, 56 are made of one of the materials mentioned above in connection with the lateral insulating packing elements 48, 49.

In the embodiment represented, the first and second external insulating packing elements 55, 56 have a stack of glass wool layers which are separated from one another by spacers 57, for example made of kraft paper, and the spacers 57 are advantageously oriented orthogonally to the bisector of the angle formed at the intersection between the first and second walls 101, 201 in order to limit the convection movements inside the glass wool.

Furthermore, between the anchoring devices 17, the corner structure 16 comprises insulating elements with a square cross section, which are arranged in the extension of the first external space with a triangular cross section 53 and the second external space with a triangular cross section 54.

FIG. 6 represents a corner structure according to another embodiment. In this embodiment, the external rigid plates 46 of the first panel 42 and of the second panel 43 also extend in the second external space with a triangular cross section 54. In this case, the second external insulating packing element 56, which is stuffed into the second external space with a triangular cross section 54, is compressed between the connecting portion 29 of the base 26 and the said external rigid plates 46.

Figure 7:
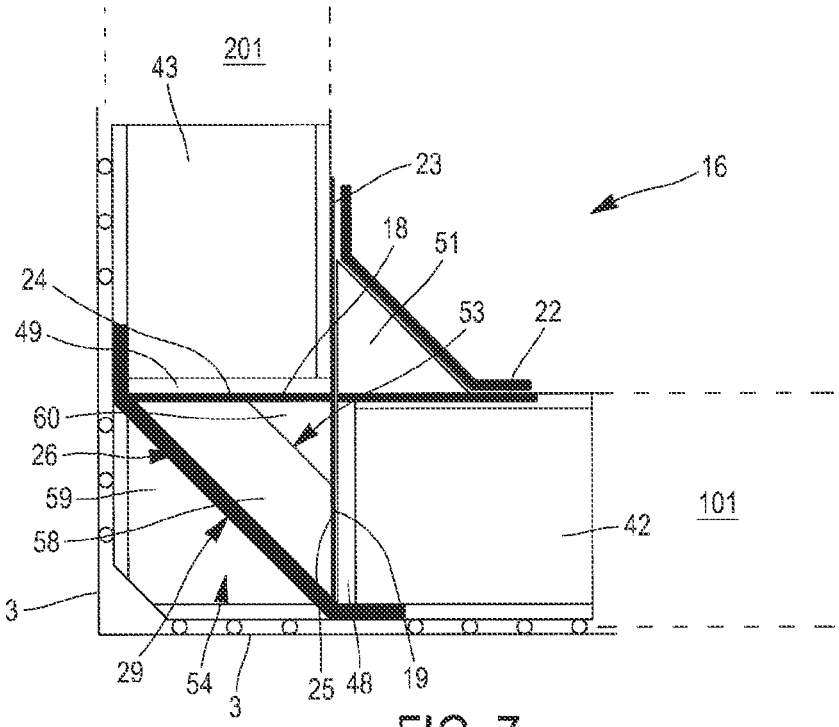
FIG. 7 is a view in section of a corner structure according to a third embodiment.

FIG. 7 represents a corner structure 16 according to another embodiment. This corner structure 16 differs only by the nature and the structure of the insulating elements accommodated in the first and second external spaces with a triangular cross section 53, 54.

Specifically, the corner structure 16 comprises an insulating panel with a trapezoidal cross section 58, which is accommodated in the first external space with a triangular cross section 53, while bearing against the connecting portion 29 of the base 26 and a part of the external portions 24, 25 of the first and second tabs 18, 19. The corner structure 16 also comprises an insulating panel with a triangular cross section 59 which is accommodated in the second external space with a triangular cross section 54. According to one embodiment, the insulating panel with a trapezoidal cross section 58 and the insulating panel with a triangular cross section 59 are made of a layer of polymer foam having a density of between 90 and 240 kg/m$^3$. The polymer foam layer is advantageously a polyurethane foam, but may also be a polyethylene foam or a polyvinyl chloride foam.

Furthermore, the rest of the first external space with a triangular cross section 53 is stuffed with a first external insulating packing element 60 which is compressed between the insulating panel with a trapezoidal cross section 58, the external portion 24 of the first tab 18 and the external portion 25 of the second tab 19. The first external insulating packing element 60 is advantageously made of one of the materials mentioned above in connection with the lateral insulating packing elements 48, 49.

Figure 9:
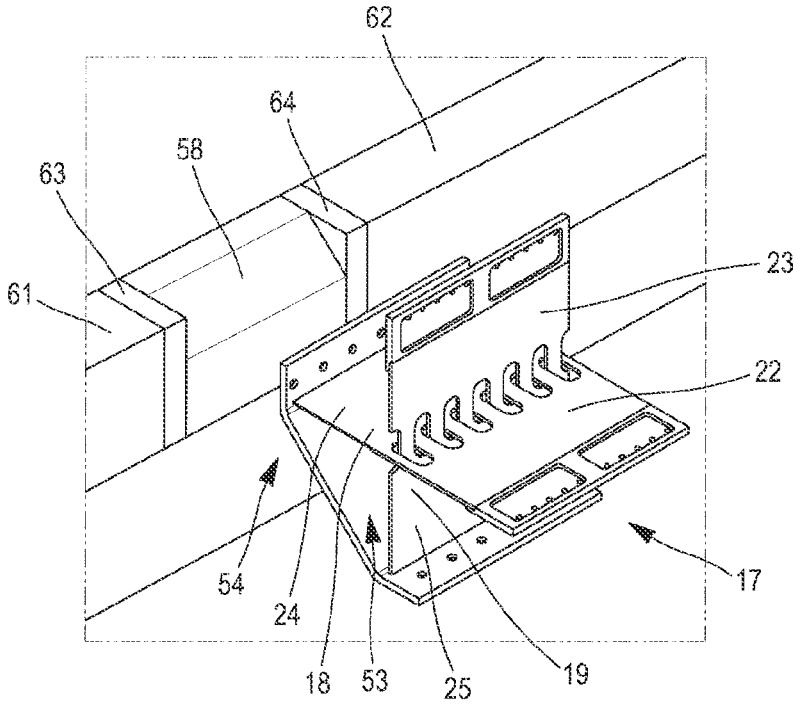
FIG. 9 is a partial perspective view of a corner structure according to one alternative embodiment.

FIG. 9 represents partially, and in an exploded view, a corner structure 16 according to one alternative embodiment. In this alternative embodiment, on either side of each anchoring device 17, the corner structure 16 comprises a third and a fourth insulating element 61, 62. The third and fourth insulating elements 61, 62 are arranged in the extension of the first external space with a triangular cross section 53 and the second external space with a triangular cross section 54.

The third and fourth insulating elements 61, 62 have a composition similar to that of the first and second insulating elements 42, 43.

Furthermore, the corner structure 16 comprises a third insulating packing element 63, which is compressed between the third insulating element 61 and the insulating components which are accommodated in the first external space with a triangular cross section 53 and in the second external space with a triangular cross section 54, namely the first and second external insulating packing elements 55, 56, and optionally the insulating panel with a trapezoidal cross section 58.

Likewise, the corner structure 16 comprises a fourth insulating packing element 64 which is compressed between, on the one hand, the third insulating element 61 and, on the other hand, the first and second external insulating packing elements 55, 56, and optionally the insulating panel with a trapezoidal cross section 58.

The third and fourth insulating packing elements 63, 64, also intend to ensure continuity of the thermal insulation and to limit the phenomena of convection inside the corner structure 16.

The technique described above for producing a tank may be used in various types of containers, for example in an onshore installation or in a floating structure such as an LNG carrier or the like.

Figure 8:
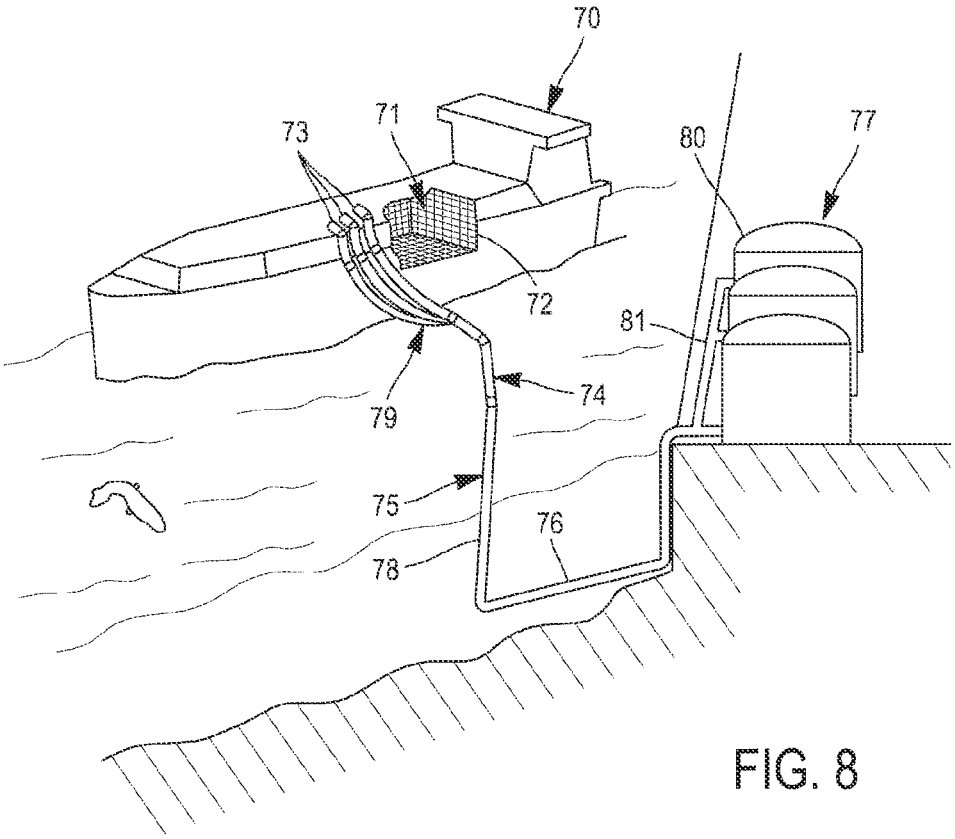
FIG. 8 is a schematic cutaway representation of a tank of an LNG ship and a terminal for loading/unloading this tank.

Referring to FIG. 8, a cutaway view of an LNG carrier 70 shows a leaktight and insulated tank 71 of prismatic overall shape mounted in the double hull 72 of the ship. The wall of the tank 71 comprises a primary leaktight barrier intended to be in contact with the LNG contained in the tank, a secondary leaktight barrier arranged between the primary leaktight barrier and the double hull 72 of the ship, and two insulating barriers arranged respectively between the primary leaktight barrier and the secondary leaktight barrier and between the secondary leaktight barrier and the double hull 72.

In a manner known per se, loading/unloading pipelines 73 arranged on the upper deck of the ship may be connected, by means of suitable connectors, to a maritime port or terminal in order to transfer an LNG cargo from or to the tank 71.

FIG. 8 represents an example of a maritime terminal comprising a loading and unloading station 75, an underwater pipe 76 and an onshore installation 77. The loading and unloading station 75 is a fixed offshore installation comprising a mobile arm 74 and a tower 78, which supports the mobile arm 74. The mobile arm 74 carries a bundle of insulated flexible tubes 79 which can be connected to the loading/unloading pipelines 73. The orientable mobile arm 74 adapts to all the gauges of LNG carriers. A connecting pipe (not represented) extends inside the tower 78. The loading and unloading station 75 makes it possible to load and unload the LNG carrier 70 from or to the onshore installation 77. The latter comprises liquefied gas storage tanks 80 and connecting pipes 81 connected by the underwater pipe 76 to the loading or unloading station 75. The underwater pipe 76 makes it possible to transfer liquefied gas between the loading or unloading station 75 and the onshore installation 77 over a large distance, for example 5 km, which makes it possible to keep the LNG carrier 70 at a large distance from the shore during the loading and unloading operations.

In order to generate the pressure necessary for transferring the liquefied gas, pumps on-board the ship 70 and/or pumps fitted in the onshore installation 77 and/or pumps fitted in the loading and unloading station 75 are used.

Although the invention has been described in connection with several particular embodiments, it is clear that it is in no way limited thereto and that it comprises all the technical equivalents of the means described as well as their combinations, if the latter fall within the scope of the invention.

The use of the verb "comprise" or "include" and its conjugated forms does not exclude the presence of elements or steps other than those mentioned in a claim.

In the claims, any reference sign in parentheses should not be interpreted as a limitation of the claim.

The invention claimed is:

1. Corner structure for a leaktight and thermally insulating tank for storing a fluid, comprising a first wall and a second wall, each of which has successively, in a thickness direction of the said wall, from the outside to the inside of the tank, a supporting structure, a thermally insulating barrier held to the supporting structure, and a sealing membrane supported by the said thermally insulating barrier; the said corner structure being intended to be arranged in a corner between the first wall and the second wall, the corner structure comprising:

a first angle bracket having a first wing and a second wing, which respectively extend in a first plane intended to be positioned parallel to the first wall and in a second plane intended to be positioned parallel to the second wall, the first wing and the second wing being respectively intended to be welded in a leaktight manner to the sealing membrane of the first wall and the sealing membrane of the second wall; the said first angle bracket being anchored to an anchoring device intended to be fastened to the supporting structure of the first and second walls;

the anchoring device comprising a first tab and a second tab intersecting one another, the first tab and the second tab extending respectively parallel to the first and to the second plane, each of the first and second tabs comprising an external portion and an internal portion which are arranged on either side of an intersection between the first tab and the second tab, the first wing of the first angle bracket being secured to the internal portion of the first tab, and the second wing of the first angle bracket being secured to the internal portion of the second tab, the external portion of the first tab and the external portion of the second tab being intended to extend from the intersection respectively towards the supporting structure of the second wall and towards the supporting structure of the first wall, the anchoring device furthermore comprising a base on which the external portions of the first and second tabs are fastened, the base comprising a first fastening portion intended to be fastened to the supporting structure of the first wall and a second fastening portion intended to be fastened to the supporting structure of the second wall; and the corner structure furthermore comprising a first insulating panel which is arranged in a first space delimited by the internal portion of the first tab and the external portion of the second tab, and a first lateral insulating packing element which is arranged between the first fastening portion and the internal portion of the first tab and is compressed between the first insulating panel and the external portion of the second tab.

2. Corner structure according to claim 1, wherein the first insulating panel comprises an insulating polymer foam layer made of a material selected from polyurethane foam, polyethylene foam and polyvinyl chloride foam.

3. Corner structure according to claim 2, wherein the insulating polymer foam layer of the first insulating panel is reinforced with fibers.

4. Corner structure according to claim 1, wherein the first lateral insulating packing element has a density of less than 90 kg/m.sup.3.

5. Corner structure according to claim 1, wherein the first lateral insulating packing element comprises a layer made of a material selected from glass wool, mineral wool, polyester wadding, polyurethane foam, melamine foam, polyethylene foam, polypropylene foam or silicone foam.

6. Corner structure according to claim 1, furthermore comprising a second insulating panel which is arranged in a second space delimited by the internal portion of the second tab and the external portion of the first tab, and a second lateral insulating packing element which is compressed between the second insulating panel and the external portion of the first tab.

7. Corner structure according to claim 1, wherein the first angle bracket comprises a central portion which connects the first wing and the second wing of the said first angle bracket and is inclined with respect to the first plane and the second plane, the central portion of the first angle bracket defining, with the internal portion of the first tab and the internal portion of the second tab, an internal space with a triangular cross section, the said internal space with a triangular cross section being stuffed with an internal insulating packing element which is compressed between the central portion of the first angle bracket, the internal portion of the first tab and the internal portion of the second tab.

8. Corner structure according to claim 1, wherein the base furthermore comprising a connecting portion which connects the first fastening portion and the second fastening portion and is inclined with respect to the first plane and the second plane, the connecting portion of the base defining, on the one hand, a first external space with a triangular cross section delimited by the connecting portion of the base, the external portion of the first tab and the external portion of the second tab, and on the other hand a second external space with a triangular cross section intended to be delimited by the connecting portion of the base, the supporting structure of the first wall and the supporting structure of the second wall.

9. Corner structure according to claim 8, wherein the first external space with a triangular cross section is stuffed with a first external insulating packing element which is compressed between the external portion of the first tab, the external portion of the second tab and the connecting portion of the base.

10. Corner structure according to claim 8, comprising an insulating panel with a trapezoidal cross section, which is accommodated in the first external space with a triangular cross section, while bearing against the connecting portion of the base, and wherein the rest of the first external space with a triangular cross section is stuffed with a first external insulating packing element WO which is compressed between the insulating panel with a trapezoidal cross section, the external portion of the first tab and the external portion of the second tab.

11. Corner structure according to claim 8, wherein the second external space with a triangular cross section is stuffed with a second external insulating packing element.

12. Corner structure according to claim 8, wherein the first external space with a triangular cross section and the second external space with a triangular cross section are respectively filled with at least one first external insulating packing element and one second external insulating packing element the corner structure furthermore comprising a third insulating panel and a fourth insulating panel on either side of the anchoring device in a direction parallel to the corner between the first wall and the second wall, the corner structure furthermore comprising a third insulating packing element which is compressed between, on the one hand, the third insulating panel and, on the other hand, the first external insulating packing element and the second external insulating packing element, and a fourth insulating packing element which is compressed between, on the one hand, the fourth insulating panel and, on the other hand, the first external insulating packing element and the second external insulating packing element.

13. Corner structure according to claim 1, wherein each of the first and second tabs comprises openings and connecting tongues formed between the openings, the connecting tongues of each of the first and second tabs passing through the openings of the other of the first and second tabs.

14. Corner structure according to claim 1, wherein the first wing and the second wing of the first angle bracket are mounted so that they can slide in a direction parallel to the intersection between the first tab and the second tab, respectively over the internal portion of the first tab and the internal portion of the second tab.

15. Leaktight and thermally insulating tank comprising a first wall and a second wall, having successively, in a thickness direction of the said wall, from the outside to the inside of the tank, a supporting structure a thermally insulating barrier held to the supporting structure, and a sealing membrane supported by the said thermally insulating barrier; the said leaktight and thermally insulating tank comprising a corner structure according to claim 1 arranged in a corner between the first wall and the second wall; the first wing and the second wing of the first angle bracket being respectively welded in a leaktight manner to the sealing membrane of the first wall and the sealing membrane of the second wall being fastened to the supporting structure of the first and second walls.

16. Ship comprising a tank according to claim 15.

17. Transfer system for a fluid, the system comprising a ship according to claim 16, insulated pipelines arranged so as to connect the tank installed in the hull of the ship to a floating or onshore storage facility, and a pump for delivering a fluid through the insulated pipelines from or to the floating or onshore storage facility to or from the tank of the ship.

18. Method for loading or unloading a ship according to claim 16, in which a fluid is conveyed through insulated pipelines from or to a floating or onshore storage facility to or from the tank of the ship.

19. Corner structure for a leaktight and thermally insulating tank for storing a fluid, comprising a first wall and a second wall, each of which has successively, in a thickness direction of the said wall, from the outside to the inside of the tank, a supporting structure, a thermally insulating barrier held to the supporting structure, and a sealing membrane supported by the said thermally insulating barrier; the said corner structure being intended to be arranged in a corner between the first wall and the second wall, the corner structure comprising:

a first angle bracket having a first wing and a second wing, which respectively extend in a first plane intended to be positioned parallel to the first wall, and in a second plane intended to be positioned parallel to the second wall, the first wing and the second wing being respectively intended to be welded in a leaktight manner to the sealing membrane of the first wall and the sealing membrane of the second wall; the said first angle bracket being anchored to an anchoring device intended to be fastened to the supporting structure of the first and second walls;

the anchoring device comprising a first tab and a second tab intersecting one another, the first tab and the second tab extending respectively parallel to the first and to the second plane, each of the first and second tabs comprising an external portion and an internal portion which are arranged on either side of an intersection between the first tab and the second tab, the first wing of the first angle bracket being secured to the internal portion of the first tab, and the second wing of the first angle bracket being secured to the internal portion of the second tab, the external portion of the first tab and the external portion of the second tab being intended to extend from the intersection respectively towards the supporting structure of the second wall and towards the supporting structure of the first wall; and the corner structure furthermore comprising a first insulating panel which is arranged in a first space delimited by the internal portion of the first tab and the external portion of the second tab, and a first lateral insulating packing element which is compressed between the first insulating panel and the external portion of the second tab;

wherein the first angle bracket comprises a central portion which connects the first wing and the second wing of the said first angle bracket and is inclined with respect to the first plane and the second plane, the central portion of the first angle bracket defining, with the internal portion of the first tab and the internal portion of the second tab, an internal space with a triangular cross section, the said internal space with a triangular cross section being stuffed with an internal insulating packing element which is compressed between the central portion of the first angle bracket, the internal portion of the first tab and the internal portion of the second tab.

20. Corner structure for a leaktight and thermally insulating tank for storing a fluid, comprising a first wall and a second wall, each of which has successively, in a thickness direction of the said wall, from the outside to the inside of the tank, a supporting structure, a thermally insulating barrier held to the supporting structure, and a sealing membrane supported by the said thermally insulating barrier; the said corner structure being intended to be arranged in a corner between the first wall and the second wall, the corner structure comprising:

a first angle bracket having a first wing and a second wing, which respectively extend in a first plane intended to be positioned parallel to the first wall, and in a second plane intended to be positioned parallel to the second wall, the first wing and the second wing being respectively intended to be welded in a leaktight manner to the sealing membrane of the first wall and the sealing membrane of the second wall; the said first angle bracket being anchored to an anchoring device intended to be fastened to the supporting structure of the first and second walls;

the anchoring device comprising a first tab and a second tab intersecting one another, the first tab and the second tab extending respectively parallel to the first and to the second plane, each of the first and second tabs comprising an external portion and an internal portion which are arranged on either side of an intersection between the first tab and the second tab, the first wing of the first angle bracket being secured to the internal portion of the first tab, and the second wing of the first angle bracket being secured to the internal portion of the second tab, the external portion of the first tab and the external portion of the second tab being intended to extend from the intersection respectively towards the supporting structure of the second wall and towards the supporting structure of the first wall; and the corner structure furthermore comprising a first insulating panel which is arranged in a first space delimited by the internal portion of the first tab and the external portion of the second tab, and a first lateral insulating packing element which is compressed between the first insulating panel and the external portion of the second tab, wherein the anchoring device furthermore comprises a base on which the external portions of the first and second tabs are fastened, the base comprising a first fastening portion intended to be fastened to the supporting structure of the first wall, and a second fastening portion intended to be fastened to the supporting structure of the second wall, the base furthermore comprising a connecting portion which connects the first fastening portion and the second fastening portion and is inclined with respect to the first plane and the second plane, the connecting portion of the base defining, on the one hand, a first external space with a triangular cross section delimited by the connecting portion of the base, the external portion of the first tab and the external portion of the second tab, and on the other hand a second external space with a triangular cross section intended to be delimited by the connecting portion of the base, the supporting structure of the first wall and the supporting structure of the second wall, and wherein the first external space with a triangular cross section and the second external space with a triangular cross section are respectively filled with at least one first external insulating packing element and one second external insulating packing element, the corner structure furthermore comprising a third insulating panel and a fourth insulating panel on either side of the anchoring device in a direction parallel to the corner between the first wall and the second wall, the corner structure furthermore comprising a third insulating packing element which is compressed between, on the one hand, the third insulating panel and, on the other hand, the first external insulating packing element and the second external insulating packing element, and a fourth insulating packing element which is compressed between, on the one hand, the fourth insulating panel and, on the other hand, the first external insulating packing element and the second external insulating packing element.

* * * * *